US011338366B2

(12) United States Patent
Rowe

(10) Patent No.: US 11,338,366 B2
(45) Date of Patent: May 24, 2022

(54) WOVEN CARBON FIBER REINFORCED NON-FERROUS METAL MATRIX COMPOSITE

(71) Applicant: Toyota Motor Engineering & Manufacturing North America, Inc., Plano, TX (US)

(72) Inventor: Michael Paul Rowe, Pinckney, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 167 days.

(21) Appl. No.: 16/230,081

(22) Filed: Dec. 21, 2018

(65) Prior Publication Data

US 2020/0198014 A1 Jun. 25, 2020

(51) Int. Cl.

| | |
|---|---|
| ***B22F 7/00*** | (2006.01) |
| ***B22F 1/00*** | (2022.01) |
| ***B22F 1/054*** | (2022.01) |

(52) U.S. Cl.

CPC ..... *B22F 7/008* (2013.01); *B22F 1/054* (2022.01); *B22F 2302/40* (2013.01); *B22F 2304/054* (2013.01)

(58) Field of Classification Search

CPC ..... B22F 1/0018; B22F 2302/40

See application file for complete search history.

(56) References Cited

U.S. PATENT DOCUMENTS

| | | | | |
|---|---|---|---|---|
| 7,338,684 | B1 | 3/2008 | Curliss et al. | |
| 2004/0005462 | A1* | 1/2004 | Fukagawa | C04B 41/87 428/411.1 |
| 2012/0153216 | A1* | 6/2012 | Wrosch | B82Y 30/00 252/74 |
| 2018/0065324 | A1* | 3/2018 | Isobe | B22F 1/0018 |
| 2018/0079884 | A1 | 3/2018 | Rowe | |
| 2019/0168420 | A1* | 6/2019 | Reese | B29B 15/14 |

OTHER PUBLICATIONS

Shirvanimoghaddam et al. (Carbon fiber reinforced metal matrix composites: Fabrication processes and properties, Composites: Part A 92 (2017) 70-96) (Year: 2017).*

Cao et al. (Stabilizing metal nanoparticles for heterogeneous catalysis, Phys. Chem. Chem. Phys., 2010, 12, 13499-13510). (Year: 2010).*

(Continued)

*Primary Examiner* — Alexandre F Ferre

(74) *Attorney, Agent, or Firm* — Christopher G. Darrow; Darrow Mustafa PC

(57) ABSTRACT

Composite materials include a non-ferrous metal matrix with reinforcing carbon fiber integrated into the matrix. The composite materials have substantially lower density than non-ferrous metal, and are expected to have appreciable strength. Methods for forming composite non-ferrous metal composites includes combining a reinforcing carbon fiber component, such as a woven polymer, with non-ferrous metal nanoparticles and sintering the non-ferrous metal nanoparticles in order to form a non-ferrous metal matrix with reinforcing carbon fiber integrated therein.

11 Claims, 2 Drawing Sheets

(56) References Cited

OTHER PUBLICATIONS

Lee, S.-K. et al., "Effect of fiber geometry on the elastic constants of the plain woven fabric reinforced aluminum matrix composites," Materials Science and Engineering, vol. A, 347, pp. 346-358 (2003).
Shirvanimoghaddam et al., "Carbon fiber reinforced metal matrix composites: Fabrication process and properties," Composites: Part A, 92, 70-96 (2017).
Adebisi et al., "Metal Matrix Composite Brake Rotors: Historical Development and Product Life Cycle Analysis," International Journal of Automotive and Mechanical Engineering (IJAME), vol. 4, pp. 471-480, (2011).
Miracle, D.B., "Metal matrix composites—From science to technological significance," Composites Science and Technology, 65, pp. 2526-2540 (2005).
Ceschini, L. et al., Aluminum and Magnesium Metal Matrix Nanocomposites, Springer Nature Singapore Pte Ltd., ISBN 978-981-10-2681-2 (eBook) (2017).
Embury, D. et al., "Steel-Based Composites: Driving Forces and Classifications," Annu. Rev. Mater. Res., 40:213-41 (2010).
Mortensen, A. et al., "Metal Matrix Composites," Annu. Rev. Mater. Res., 40:243-70 (2010).

* cited by examiner

WOVEN CARBON FIBER REINFORCED NON-FERROUS METAL MATRIX COMPOSITE

TECHNICAL FIELD

The present disclosure generally relates to metal/polymer composite materials and, more particularly, to a lightweight composite of non-ferrous metal and a reinforcing carbon fiber, and method of making the same.

BACKGROUND

The background description provided herein is for the purpose of generally presenting the context of the disclosure. Work of the presently named inventors, to the extent it may be described in this background section, as well as aspects of the description that may not otherwise qualify as prior art at the time of filing, are neither expressly nor impliedly admitted as prior art against the present technology.

Non-ferrous metals having high strength and relatively low density have numerous uses. For example, titanium and alloys of titanium are used in spacecraft, armor, and multiple other applications that benefit from a high strength-to-weight ratio. Increasing the strength-to-weight ratio of such non-ferrous metals would generally improve performance in these applications.

Composite materials can be formed by integrating a reinforcing carbon fiber fully integrated in a metal matrix, and have the potential to improve the strength-to-weight ratio over that of the metal alone. However, in many instances, a non-ferrous metal has a melting temperature substantially higher than the thermal decomposition of such a reinforcing fiber. Titanium, for example, is typically formed by conventional forging methods at temperatures in excess of 1500° C., and tungsten carbide has a melting temperature in excess of 2800° C. Carbon fiber will degrade in the presence of oxygen at around 300° C., and can lose strength in the temperature range of 300 to 1000° C. in a non-oxidative environment due to growth of surface flaws and/or mass loss. This indicates that the formation of composite materials, having non-ferrous metals fully integrated with carbon fiber reinforcement, can be difficult or impossible to prepare in many instances. Methods enabling formation of such a composite material would be desirable.

SUMMARY

This section provides a general summary of the disclosure, and is not a comprehensive disclosure of its full scope or all of its features.

In various aspects, the present teachings provide a composite material having a continuous non-ferrous metal matrix of sintered non-ferrous metal nanoparticles and at least one reinforcing carbon fiber that is at least partially encapsulated within the non-ferrous metal matrix. In some implementations, the at least one reinforcing carbon fiber is fully encapsulated within the continuous non-ferrous metal matrix. In some implementations, the composite material can have density less than 5 g/cm$^3$.

In other aspects, the present teachings provide a composite material. The composite material includes at least one reinforcing carbon fiber, and a continuous non-ferrous metal matrix, of sintered non-ferrous metal nanoparticles, disposed around the at least one reinforcing carbon fiber.

In still other aspects, the present teachings provide a method for forming composite non-ferrous metal. The method includes a step of providing non-ferrous metal nanoparticles and a step of combining non-ferrous metal nanoparticles with a reinforcing carbon fiber component to form an unannealed combination. The method further includes a step of sintering the non-ferrous metal nanoparticles around the reinforcing carbon fiber component by applying elevated temperature to the unannealed combination.

Further areas of applicability and various methods of enhancing the above coupling technology will become apparent from the description provided herein. The description and specific examples in this summary are intended for purposes of illustration only and are not intended to limit the scope of the present disclosure.

BRIEF DESCRIPTION OF THE DRAWINGS

The present teachings will become more fully understood from the detailed description and the accompanying drawings, wherein.

It should be noted that the figures set forth herein are intended to exemplify the general characteristics of the methods, algorithms, and devices among those of the present technology, for the purpose of the description of certain aspects. These figures may not precisely reflect the characteristics of any given aspect, and are not necessarily intended to define or limit specific embodiments within the scope of this technology. Further, certain aspects may incorporate features from a combination of figures.

DETAILED DESCRIPTION

The present disclosure generally relates to composite materials including a non-ferrous metal matrix with a reinforcing carbon fiber integrated into the matrix. The composite materials have a substantially lower density than non-ferrous metal, and have appreciable strength. Methods for forming polymer-non-ferrous metal composites include combining a reinforcing carbon fiber component, such as an aromatic polyamide, with non-ferrous metal nanoparticles and sintering the non-ferrous metal nanoparticles in order to form a non-ferrous metal matrix with a reinforcing carbon fiber integrated therein.

Conventional non-ferrous metal melts at temperatures of greater than about 1200° C. Such high temperatures would instantly destroy various reinforcing carbon fibers on contact, which decomposes at about 450° C. or less. Accordingly, the present technology for forming a non-ferrous metal/polymer composite employs non-ferrous metal nanoparticles, lowering the melting point of non-ferrous metal to less than about 450° C. When combined and heated, this allows for the non-ferrous metal nanoparticles to sinter around the reinforcing carbon fiber component, without destroying the reinforcing carbon fiber component. The result is layer(s) or extending fibers of a reinforcing carbon fiber interpenetrated in a non-ferrous metal matrix.

A composite of the present disclosure can have significantly lower density than conventional non-ferrous metal, as low as 60% in one example. The composite can also provide considerable structural strength, including tensile strength.

Figure 1:
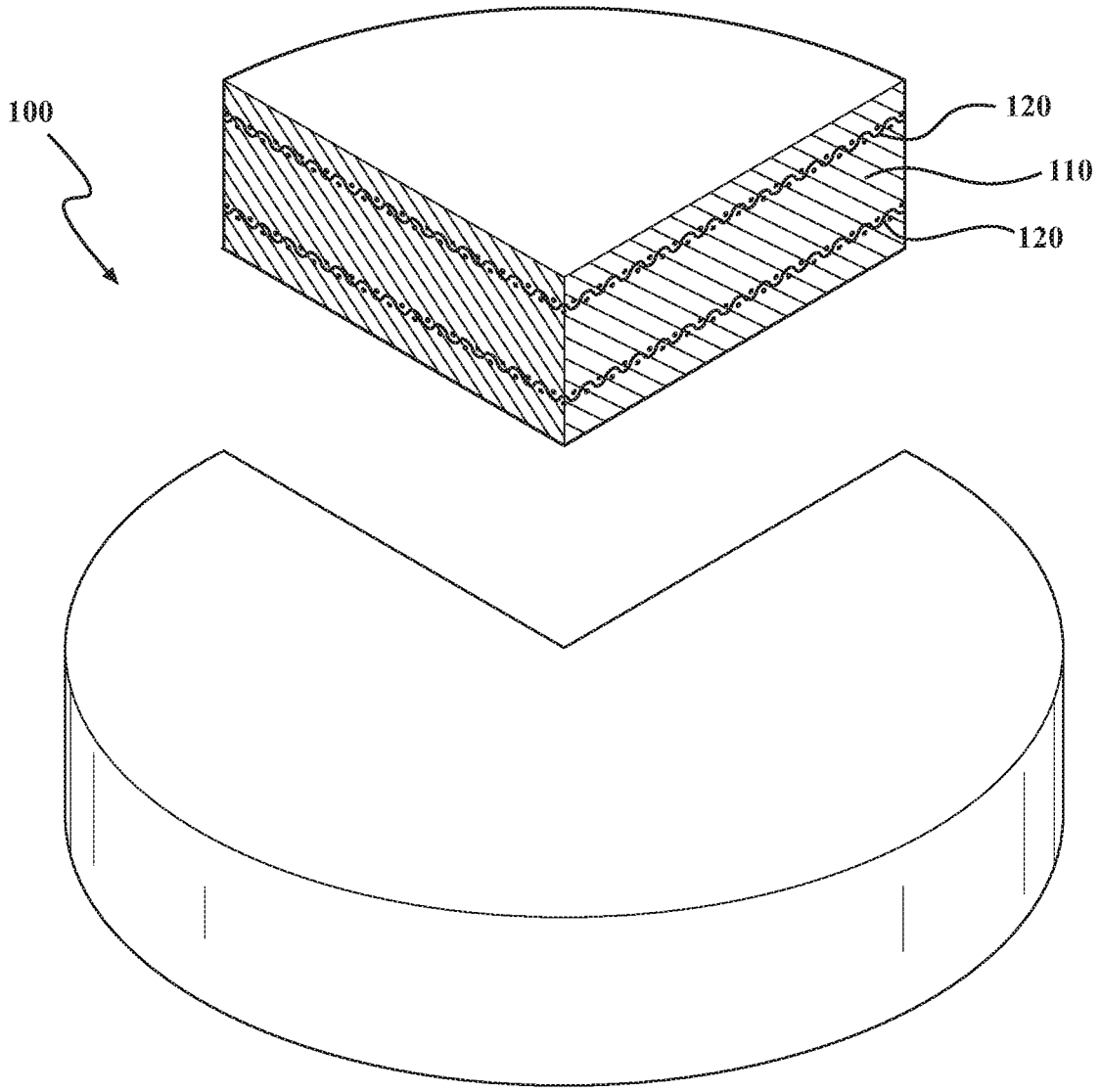
FIG. 1 is cross section of composite non-ferrous metal having a non-ferrous metal matrix with two layers of reinforcing carbon fiber.

With reference to FIG. 1, a carbon fiber reinforced non-ferrous metal matrix composite (CF-MMC) 100 includes a continuous non-ferrous metal matrix 110 and at least one reinforcing carbon fiber 120 that is at least partially encapsulated within the non-ferrous metal matrix. As shown, the reinforcing carbon fiber 120 can be provided as a layer of fabric, cloth, weave, woven yarn, etc. In other instances, the reinforcing carbon fiber 120 can be provided as a fiber, yarn, or a plurality of aligned fibers.

The continuous non-ferrous metal matrix 110 generally includes sintered non-ferrous metal nanoparticles. Suitable non-ferrous metals can include, without limitation, titanium, tungsten, copper, zinc, nickel, tin, aluminum, germanium, and alloys such as brass, tungsten carbide, and bronze. In the case of alloys, relative ratios of the various metal components of the non-ferrous metal matrix 110 can depend on the desired application, and will generally be selectable based on common knowledge to one of skill in the art. For example, tungsten carbide can include tungsten semicarbide.

In some implementations, the term "continuous", as used in the phrase, "continuous non-ferrous metal matrix 110" can mean that the non-ferrous metal matrix is formed as, or is present as, a unitary, integral body. In such implementations, and as a negative example, a structure formed of two distinct non-ferrous metal bodies held together such as with an adhesive or with a weld would be discontinuous. In some implementations, the term "continuous" as used herein can mean that a continuous non-ferrous metal matrix 110 is substantially compositionally and structurally homogeneous throughout its occupied volume. For simplicity, the continuous non-ferrous metal matrix 110 will be alternatively referred to herein as "non-ferrous metal matrix 110", i.e. the word "continuous" will at times be omitted without changing the meaning.

In some implementations of the CF-MMC 100, the at least one reinforcing carbon fiber 120 can be fully encapsulated within the continuous non-ferrous metal matrix 110. In various implementations, the expression, "encapsulated within the continuous non-ferrous metal matrix 110" can mean that the at least one reinforcing carbon fiber 120 is, partially or fully: encased in, enclosed in, enveloped in, integrated into, or otherwise contactingly surrounded by, the continuous non-ferrous metal matrix 110. In some implementations, the expression, "encapsulated within the continuous non-ferrous metal matrix 110" can mean that at least a portion of individual fibers comprising the at least one reinforcing carbon fiber 120 are contactingly surrounded by the continuous non-ferrous metal matrix 110. In some implementations, the expression, "encapsulated within the continuous non-ferrous metal matrix 110" can mean that the continuous non-ferrous metal matrix 110 is, partially or fully: formed around or otherwise contactingly disposed around the at least one reinforcing carbon fiber 120.

In some implementations, the expression stating that the at least one reinforcing carbon fiber 120 is "encapsulated within the non-ferrous metal matrix" means that the non-ferrous metal matrix 110 is formed around and within the reinforcing carbon fiber 120 with sufficiently high contact between surfaces of the non-ferrous metal matrix 110 and surfaces of the reinforcing carbon fiber 120 to hold the reinforcing carbon fiber 120 in place relative to the non-ferrous metal matrix 110. In some implementations, the expression stating that the reinforcing carbon fiber 120 is "encapsulated within the non-ferrous metal matrix" means that an interacting surface of the non-ferrous metal matrix 110 is presented to and bonded with all sides of individual polymer fibers that constitute the reinforcing carbon fiber 120.

In various implementations, the expression, "sufficiently high contact between surfaces of the non-ferrous metal matrix and surfaces of the reinforcing carbon fiber to hold the reinforcing carbon fiber in place relative to the non-ferrous metal matrix can mean that at least 50%, or at least 60%, or at least 70% or at least 80%, or at least 90% of the surface area of the reinforcing carbon fiber 120 is contacted by the non-ferrous metal matrix.

It will be appreciated that incorporation of carbon fiber into a non-ferrous metal matrix allows for the reduction of weight without a loss in strength. For example, titanium has a density of 4.5 g/cm$^3$ and carbon fiber is 2 g/cm$^3$. Therefore, inclusion of carbon fiber can dramatically lower the weight of such a non-ferrous metal matrix composite (MMC), without a loss in strength. The amount of weight reduction is directly dependent upon the amount of carbon fiber used in the MMC.

In general, the CF-MMC 100 will have a total density that is less than the density of pure non-ferrous metal. For example, mild non-ferrous metal such as AISI grades 1005 through 1025 has a density of about 7.88 g/cm$^3$. In contrast, an exemplary CF-MMC 100 of the present disclosure has a density of 4.8 g/cm$^3$, about 61% of the density of mild non-ferrous metal. In comparison to this, recently developed non-ferrous metal-aluminum alloys have a density approximately 87% that of mild non-ferrous metal.

While FIG. 1 illustrates a CF-MMC 100 having two layers of reinforcing carbon fiber 120 encapsulated within the non-ferrous metal matrix 110, it is to be understood that the composite material can include any number of layers of reinforcing carbon fiber 120 greater than or equal to one. Stated alternatively, the at least one reinforcing carbon fiber 120 can, in some implementations, include a plurality of mutually contacting or spatially separated layers of reinforcing carbon fiber. It is further to be understood that the weight ratio of reinforcing carbon fiber 120 to non-ferrous metal matrix 110 within the CF-MMC 100 can be substantially varied, and that such variation will have a direct influence on the density of the CF-MMC 100 given the considerably different densities of various polymers, such as aromatic polyamides (about 2.1 g/cm$^3$), and non-ferrous metal.

Thus, in some implementations, a CF-MMC 100 of the present disclosure will have density less than 7 g/cm$^3$. In some implementations, a CF-MMC 100 of the present disclosure will have density less than 6 g/cm$^3$. In some implementations, a CF-MMC 100 of the present disclosure will have density less than 5 g/cm$^3$.

Figure 2:
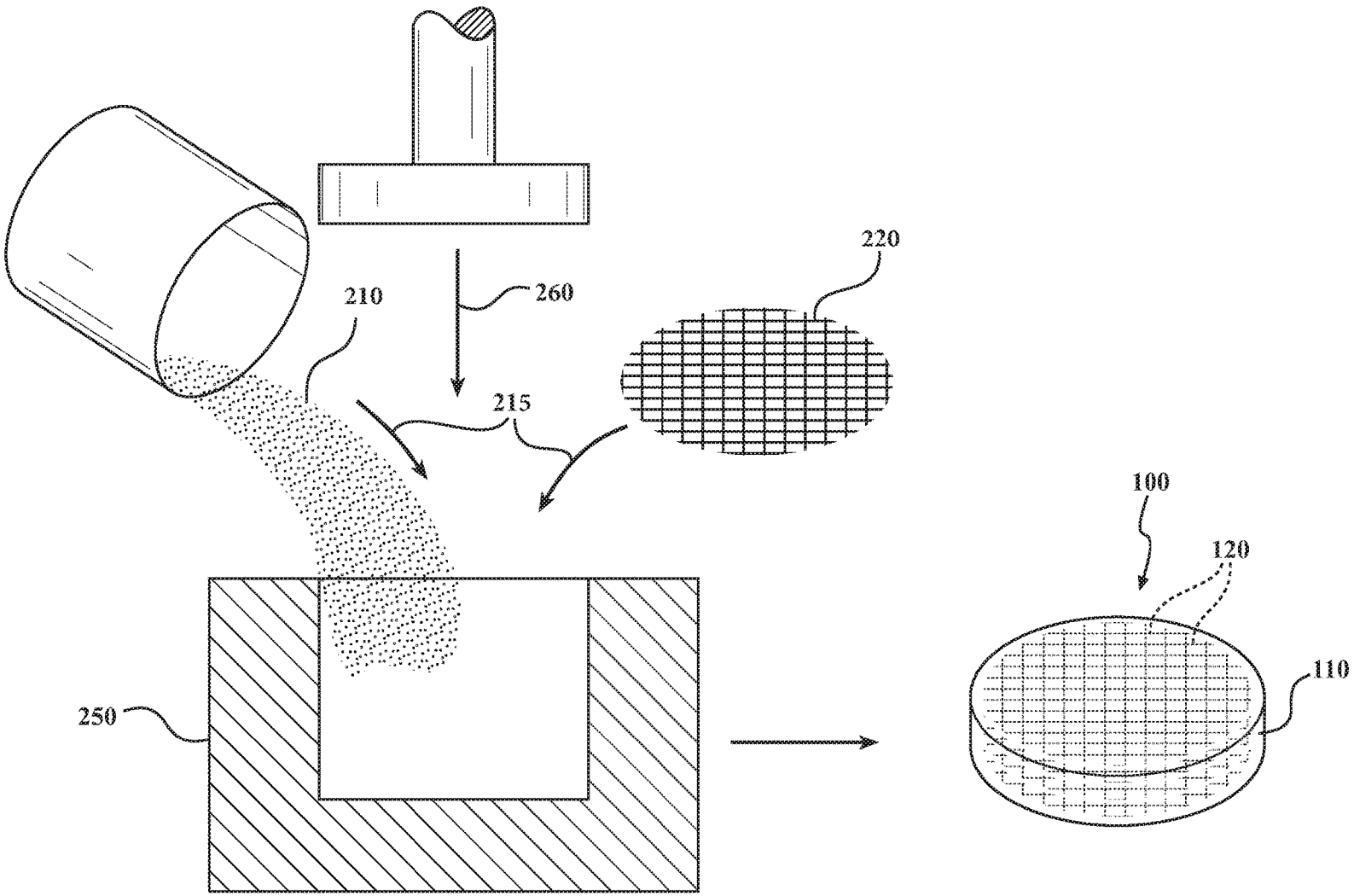
FIG. 2 is a pictorial view of a portion of a method for forming a composite material of the type shown in FIG. 1.

Also disclosed is a method for forming a CF-MMC 100. With reference to FIG. 2, the method includes a step of providing non-ferrous metal nanoparticles 210. The term "non-ferrous metal nanoparticles 210" refers generally to a sample consisting predominantly of particles of non-ferrous metal having an average maximum dimension less than 100 nm. Individual particles of the non-ferrous metal nanoparticles 210 will generally consist of any alloy as compositionally described above with respect to the non-ferrous metal matrix 110 of the CF-MMC 100. As such, individual particles of the non-ferrous metal nanoparticles 210 will generally include iron and carbon; and can optionally include any, several, or all, of: manganese, nickel, chromium, molybdenum, boron, titanium, vanadium, tungsten, cobalt, niobium, phosphorus, sulfur, and silicon.

As described above with respect to the non-ferrous metal matrix 110 of a CF-MMC 100, relative ratios of the various elemental components of the non-ferrous metal nanoparticles 210 can depend on the desired application, and will generally be selectable based on common knowledge to one of skill in the art. In a disclosed Example, the individual particles of the non-ferrous metal nanoparticles 210 consist of iron, carbon, and manganese present at 99.08%, 0.17%, and 0.75%, respectively, by weight.

In various aspects, the average maximum dimension of the non-ferrous metal nanoparticles 210 can be determined by any suitable method, including but not limited to, x-ray diffraction (XRD), Transmission Electron Microscopy, Scanning Electron Microscopy, Atomic Force Microscopy, Photon Correlation Spectroscopy, Nanoparticle Surface Area Monitoring, Condensation Particle Counter, Differential Mobility Analysis, Scanning Mobility Particle Sizing, Nanoparticle Tracking Analysis, Aerosol Time of Flight Mass Spectroscopy, or Aerosol Particle Mass Analysis.

In some implementations, the average maximum dimension will be an average by mass, and in some implementations will be an average by population. In some instances, the non-ferrous metal nanoparticles 210 can have an average maximum dimension less than about 50 nm, or less than about 40 nm, or less than about 30 nm, or less than about 20 nm, or less than about 10 nm.

In some aspects, the average maximum dimension can have a relative standard deviation. In some such aspects, the relative standard deviation can be less than 0.1, and the non-ferrous metal nanoparticles 210 can thus be considered monodisperse.

With continued reference to FIG. 2, the method for forming CF-MMC 100 additionally includes a step of combining 215 the non-ferrous metal nanoparticles 210 with a reinforcing carbon fiber component 220 to produce an unannealed combination. The reinforcing carbon fiber component 220 is in all respects identical to the reinforcing carbon fiber 120 as described above with respect to a CF-MMC 100, with the exception that the reinforcing carbon fiber component 220 is not yet integrated into, or encapsulated within, a non-ferrous metal matrix 110 as defined above. Thus, the reinforcing carbon fiber component 220 can include, for example, carbon fibers formed in any configuration designed to impart tensile strength in at least one dimension, in some aspects in at least two-dimensions.

In many implementations, the combining step 215 will include sequentially combining at least one layer of non-ferrous metal nanoparticles 210 and at least one layer of reinforcing carbon fiber component 220, such that the unannealed combination consists of one or more layers each of non-ferrous metal nanoparticles 210 and reinforcing carbon fiber component 220. Any number of layers of non-ferrous metal nanoparticles 210 and any number of layers of reinforcing carbon fiber component 220 can be employed. It will be understood that in implementations where reinforcing carbon fiber 120 is desired at an exterior surface of the CF-MMC 100, a reinforcing carbon fiber component 220 will be the first and/or last sequentially layered component in the unannealed combination; and in implementations were reinforcing carbon fiber 120 is desired between exterior surfaces of the CF-MMC 100, a layer of reinforcing carbon fiber component 220 will be preceded and followed by a layer of non-ferrous metal nanoparticles 210.

The combining step 215 will generally include combining the non-ferrous metal nanoparticles 210 and the reinforcing carbon fiber component 220 within a die, cast, mold, or other shaped structure having a void space corresponding to the desired shape of the CF-MMC 100 to be formed. In some particular implementations, the at least one layer of non-ferrous metal nanoparticles 210 and the at least one layer of reinforcing carbon fiber component 220 will be combined within a heat press die 250.

In some implementations, the method for forming CF-MMC 100 can include a step of manipulating non-ferrous metal nanoparticles 210 in the unannealed combination into interstices in the reinforcing carbon fiber component 220. Such a manipulating step can be effective to maximize surface area of contact between non-ferrous metal nanoparticles 210 and the reinforcing carbon fiber component 220 in the unannealed combination, improving the effectiveness of integration of the reinforcing carbon fiber 120 into the non-ferrous metal matrix 110 of the eventually formed CF-MMC 100. Manipulating non-ferrous metal nanoparticles 210 into interstices in the reinforcing carbon fiber component 220 can be accomplished by any procedure effective to increase surface area of contact between non-ferrous metal nanoparticles 210 and reinforcing carbon fiber component 220, including without limitation: pressing, agitating, shaking, vibrating, sonicating, or any other suitable procedure.

The method for forming CF-MMC 100 additionally includes a step of sintering the non-ferrous metal nanoparticles 210, converting the non-ferrous metal nanoparticles 210 into a non-ferrous metal matrix 110 such that the reinforcing carbon fiber component 220 becomes reinforcing carbon fiber 120 integrated into the non-ferrous metal matrix 110; and thus converting the unannealed combination into CF-MMC 100. The sintering step generally includes heating the unannealed combination to a temperature less than 450° C. and sufficiently high to sinter the non-ferrous metal nanoparticles 210. In some implementations, the sintering step can include heating the unannealed combination to a temperature greater than 400° C. and less than 450° C. In some implementations, the sintering step can include heating the unannealed combination to a temperature greater than 420° C. and less than 450° C.

In some implementations, the sintering step can be achieved by hot compaction, i.e. by applying elevated pressure 260 simultaneous to the application of elevated temperature. In some implementations employing hot compaction, the elevated pressure can be at least 30 MPa; and in some implementations, the elevated pressure can be at least 60 MPa. Depending on the sintering conditions of temperature and pressure, the duration of the sintering step can vary. In some implementations, the sintering step can be performed for a duration within a range of 2-10 hours, and in one disclosed Example is performed for a duration of 4 hours.

The carbon fiber reinforced non-ferrous metal matrix composite (CF-MMC) is made by charging a die with alternating layers of non-ferrous metal powder and carbon fiber cloth. The non-ferrous metal powder used can be nanoparticles, <45 micron powder, or a mixture of the two size regimes. The weave of the carbon fiber cloth is loose enough to allow penetration between the fibers so that the non-ferrous metal matrix around the reinforcement is allowed to be continuous after consolidation.

The carbon fiber cloth and non-ferrous metal powder are assembled in the die under an inert atmosphere (inside an argon glove box) to prevent oxidized surfaces from forming. The final punch and die assembly is then compacted at 800° C. with 60 MPa of pressure for 1 hour, under an argon flow.

The carbon fiber has a lower density than non-ferrous metal (by a factor of ~3.75) and has a higher tensile strength. Addition of multiple carbon fiber layers to the non-ferrous metal matrix lowers the weight of the final composite (as a function of the lower carbon fiber density) and increases the tensile strength as a function of its contribution to the mechanical strength of the composite.

It will be appreciated that in some instances, providing non-ferrous metal nanoparticles 210 having a desired composition, average maximum dimension, and/or relative standard deviation of the average maximum dimension may be difficult to achieve by conventional methods. For example, "top down" approaches involving fragmentation of bulk non-ferrous metal into particulate non-ferrous metal via milling, arc detonation, or other known procedures will often provide non-ferrous metal particles that are too large and/or too heterogeneous for effective sintering into a uniform, robust non-ferrous metal matrix 110. "Bottom up" approaches, such as those involving chemical reduction of dissolved cations, will often be unsuitable for various alloy nanoparticles due to incompatible solubilities, or even unavailability, of the relevant cations. For example, cationic carbon, that is suitable for chemical co-reduction with cationic iron to form non-ferrous metal, may be difficult to obtain. Further, even where these techniques or others may be effective to produce non-ferrous metal nanoparticles 210 of a given composition at laboratory scale, scale up may prove unfeasible or uneconomical.

For these reasons, the step of providing non-ferrous metal nanoparticles 210 can in many implementations be performed by a novel non-ferrous metal nanoparticle 210 synthesis using Anionic Element Reagent Complexes (AERCs). An AERC generally is a reagent consisting of one or more elements in complex with a hydride molecule, and having a formula:

$$Q^0 \cdot X_y \qquad \text{Formula I,}$$

wherein $Q^0$ represents a combination of one or more elements, each formally in oxidation state zero and not necessarily in equimolar ratio relative to one another; X represents a hydride molecule, and y is an integral or fractional value greater than zero. An AERC of Formula I can be formed by ball-milling a mixture that includes: (i) powders of each of the one or more elements, present at the desired molar ratios; and (ii) a powder of the hydride molecule, present at a molar ratio relative to the combined one or more elements that corresponds to y. In many implementations, the hydride molecule will be a borohydride, and in some specific implementations the hydride molecule will be lithium borohydride.

Contacting an AERC of Formula I with a suitable solvent and/or ligand molecule will result in formation of nanoparticles consisting essentially of the one or more elements, the one or more elements being present in the nanoparticles at ratios equivalent to which they are present in the AERC.

Thus, an AERC suitable for use in non-ferrous metal nanoparticle 210 synthesis generally has a formula:

$$M_a \cdot X_y \qquad \text{Formula II,}$$

where M represents one or more elements in oxidation state zero, each of the one or more elements selected from a group consisting of: titanium, tungsten, copper, zinc, nickel, tin, aluminum, and germanium; X is a hydride molecule as defined with respect to Formula I; a is a fractional or integral value greater than zero; and y is a fractional or integral value greater than or equal to zero. It will be appreciated that the values of a, b, and c will generally correspond to the molar ratios of the various components in the desired composition of non-ferrous metal. It is further to be understand that a and y are shown as singular values for simplicity only, and can correspond to multiple elements present at non-equimolar quantities relative to one another. An AERC of Formula II can alternatively be referred to as a non-ferrous metal-AERC.

Formation of a non-ferrous metal-AERC can be accomplished by ball-milling a mixture that includes: (I) a powder of a hydride molecule, such as lithium borohydride; and (II) a powder of a non-ferrous metal mixture that includes at least one metal selected from the group consisting of: titanium, tungsten, copper, zinc, nickel, tin, aluminum, and germanium. The molar ratios of metal powder to hydride molecule can vary; and in instances where more than one metal powder is used, to produce an alloy, the molar ratios of the metal powders can vary, in order to achieve the desired alloy combination.

Thus, in some implementations, a disclosed process for synthesizing non-ferrous metal nanoparticles includes a step of contacting a non-ferrous metal-AERC, such as one defined by Formulae I or II, with a solvent. In some implementations, the disclosed process for synthesizing non-ferrous metal nanoparticles includes a step of contacting a non-ferrous metal-AERC, such as one defined by Formulae I or II, with a ligand. In some implementations, the disclosed process for synthesizing non-ferrous metal nanoparticles includes a step of contacting a non-ferrous metal-AERC, such as one defined by Formulae I or II, with a solvent and a ligand. Contacting a non-ferrous metal-AERC with a suitable solvent and/or ligand will result in formation of non-ferrous metal nanoparticles 210 having alloy composition dictated by the composition of the non-ferrous metal-AERC, and thus by the composition of the pre-non-ferrous metal mixture from which the non-ferrous metal-AERC was formed.

Non-limiting examples of suitable ligands can include nonionic, cationic, anionic, amphoteric, zwitterionic, and polymeric ligands and combinations thereof. Such ligands typically have a lipophilic moiety that is hydrocarbon based, organosilane based, or fluorocarbon based. Without implying limitation, examples of types of ligands which can be suitable include alkyl sulfates and sulfonates, petroleum and lignin sulfonates, phosphate esters, sulfosuccinate esters, carboxylates, alcohols, ethoxylated alcohols and alkylphenols, fatty acid esters, ethoxylated acids, alkanolamides, ethoxylated amines, amine oxides, nitriles, alkyl amines, quaternary ammonium salts, carboxybetaines, sulfobetaines, or polymeric ligands. In some particular implementations, a ligand can be at least one of a nitrile, an amine, and a carboxylate.

Non-limiting examples of suitable solvents can include any molecular species, or combination of molecular species, capable of interacting with the constituents of an AERC by means of non-bonding or transient-bonding interactions. In different implementations, a suitable solvent for synthesis of non-ferrous metal nanoparticles 210 from a non-ferrous metal-AERC can be a hydrocarbon or aromatic species, including but not limited to: a straight-chain, branched, or cyclic alkyl or alkoxy; or a monocyclic or multicyclic aryl or heteroaryl. In some implementations, the solvent will be a non-coordinating or sterically hindered ether. The term solvent as described can in some variations include a deuterated or tritiated form. In some implementation, a solvent can be an ether, such as THF.

The foregoing description is merely illustrative in nature and is in no way intended to limit the disclosure, its application, or uses. As used herein, the phrase at least one of A, B, and C should be construed to mean a logical (A or B or C), using a non-exclusive logical "or." It should be understood that the various steps within a method may be executed in different order without altering the principles of the present disclosure; various steps may be performed independently or at the same time unless otherwise noted. Disclosure of ranges includes disclosure of all ranges and subdivided ranges within the entire range.

The headings (such as "Background" and "Summary") and sub-headings used herein are intended only for general organization of topics within the present disclosure, and are not intended to limit the disclosure of the technology or any aspect thereof. The recitation of multiple embodiments having stated features is not intended to exclude other embodiments having additional features, or other embodiments incorporating different combinations of the stated features.

As used herein, the terms "comprise" and "include" and their variants are intended to be non-limiting, such that recitation of items in succession or a list is not to the exclusion of other like items that may also be useful in the devices and methods of this technology. Similarly, the terms "can" and "may" and their variants are intended to be non-limiting, such that recitation that an embodiment can or may comprise certain elements or features does not exclude other embodiments of the present technology that do not contain those elements or features.

The broad teachings of the present disclosure can be implemented in a variety of forms. Therefore, while this disclosure includes particular examples, the true scope of the disclosure should not be so limited since other modifications will become apparent to the skilled practitioner upon a study of the specification and the following claims. Reference herein to one aspect, or various aspects means that a particular feature, structure, or characteristic described in connection with an embodiment is included in at least one embodiment or aspect. The appearances of the phrase "in one aspect" (or variations thereof) are not necessarily referring to the same aspect or embodiment.

While particular embodiments have been described, alternatives, modifications, variations, improvements, and substantial equivalents that are or may be presently unforeseen may arise to applicants or others skilled in the art. Accordingly, the appended claims as filed and as they may be amended, are intended to embrace all such alternatives, modifications variations, improvements, and substantial equivalents.

What is claimed is:

1. A composite material comprising:

a continuous non-ferrous metal matrix of sintered non-ferrous metal nanoparticles sintered at a temperature of less than 450° C.; and at least one reinforcing carbon fiber, a portion of which is contactingly surrounded by the non-ferrous metal matrix, wherein at least 50% of a surface area of the at least one reinforcing carbon fiber contacts the non-ferrous metal matrix.

2. The composite material as recited in claim 1, wherein the at least one reinforcing carbon fiber is fully encapsulated within the non-ferrous metal matrix.

3. The composite material as recited in claim 1, wherein the at least one reinforcing carbon fiber comprises a plurality of spatially separated layers of reinforcing carbon fiber.

4. The composite material as recited in claim 1, having density less than 7 g/cm$^3$.

5. The composite material as recited in claim 1, having density less than 6 g/cm$^3$.

6. The composite material as recited in claim 1, having density less than 5 g/cm$^3$.

7. The composite material as recited in claim 1, wherein the continuous non-ferrous metal matrix comprises an alloy of at least one non-ferrous metal selected from the group consisting of: titanium, tungsten, copper, zinc, nickel, tin, aluminum, and germanium.

8. A composite material comprising:

at least one reinforcing carbon fiber; and a continuous metal matrix, of sintered metal nanoparticles sintered at a temperature less than 450° C., having an average dimension less than 20 nm and formed of a metal selected from a group consisting of titanium and tungsten, contactingly surrounding at least a portion of the at least one reinforcing carbon fiber, wherein at least 50% of a surface area of the at least one reinforcing carbon fiber contacts the non-ferrous metal matrix.

9. The composite material as recited in claim 8, having density less than 7 g/cm$^3$.

10. The composite material as recited in claim 8, having density less than 6 g/cm$^3$.

11. The composite material as recited in claim 8, having density less than 5 g/cm$^3$.

* * * * *